US012108864B1

(12) United States Patent
Yang

(10) Patent No.: US 12,108,864 B1
(45) Date of Patent: Oct. 8, 2024

(54) REAR-PRESSING ANTI-MISOPERATION DOUBLE-ENDED EYEBROW PENCIL

(71) Applicant: SHYA HSIN PACKAGING INDUSTRY (CHINA) CO., LTD., Kunshan (CN)

(72) Inventor: Haiying Yang, Kunshan (CN)

(73) Assignee: SHYA HSIN PACKAGING INDUSTRY (CHINA) CO., LTD., Kunshan (CN)

( * ) Notice: Subject to any disclaimer, the term of this patent is extended or adjusted under 35 U.S.C. 154(b) by 0 days.

(21) Appl. No.: 18/580,173

(22) PCT Filed: Oct. 6, 2022

(86) PCT No.: PCT/CN2022/123716
§ 371 (c)(1),
(2) Date: Jan. 18, 2024

(87) PCT Pub. No.: WO2023/103561
PCT Pub. Date: Jun. 15, 2023

(30) Foreign Application Priority Data

Dec. 8, 2021 (CN) ..... 202111495530.4

(51) Int. Cl.
*A45D 40/20* (2006.01)
*A45D 40/26* (2006.01)

(52) U.S. Cl.
CPC ..... *A45D 40/205* (2013.01); *A45D 40/262* (2013.01); *A45D 2040/201* (2013.01); *A45D 2040/208* (2013.01)

(58) Field of Classification Search
CPC ..... A45D 40/205; A45D 40/262; A45D 2040/208; A45D 40/20; A45D 2040/201; A45D 34/042
USPC ..... 401/37, 39, 52, 75, 172, 174
See application file for complete search history.

(56) References Cited

U.S. PATENT DOCUMENTS

| | | | | |
|---|---|---|---|---|
| 2008/0240839 | A1 | 10/2008 | Zhang | |
| 2018/0303219 | A1* | 10/2018 | Sasaki | A46B 9/021 |
| 2020/0121058 | A1* | 4/2020 | Tani | B43K 8/03 |

FOREIGN PATENT DOCUMENTS

| | | | |
|---|---|---|---|
| CN | 200950888 | Y | 9/2007 |
| CN | 103373138 | A | 10/2013 |
| CN | 206491443 | U | 9/2017 |
| CN | 110087892 | A | 8/2019 |
| CN | 114468517 | A | 5/2022 |

(Continued)

*Primary Examiner* — David J Walczak
(74) *Attorney, Agent, or Firm* — Bayramoglu Law Offices LLC

(57) ABSTRACT

A rear-pressing anti-misoperation double-ended eyebrow pencil includes a nib, a front lid, a piston, an intermediate ring, a pencil body, a threaded rod, a nut, a first spring, a ratchet wheel, a ratchet seat, a ratchet rod, a shoulder sleeve, a bristle carrier, a bristle, an inner sleeve, a tail lid, and a button, where the intermediate ring is sleeved on the hollow pencil body; the threaded rod is provided with a screw thread and rotatably provided on the nut; one end of the piston abuts against a material, and the other end of the piston abuts against the threaded rod; the piston can move to an outlet under pushing of the threaded rod; an end of the ratchet wheel adjacent to the ratchet rod is provided with a first unidirectional jump tooth; and an end of the ratchet rod adjacent to the ratchet wheel is provided with a ratchet.

16 Claims, 6 Drawing Sheets

(56) References Cited

FOREIGN PATENT DOCUMENTS

| | | | |
|---|---|---|---|
| CN | 217137114 | U | 8/2022 |
| TW | M316011 | U | 8/2007 |

* cited by examiner

REAR-PRESSING ANTI-MISOPERATION DOUBLE-ENDED EYEBROW PENCIL

CROSS REFERENCE TO THE RELATED APPLICATIONS

This application is the national phase entry of International Application No. PCT/CN2022/123716, filed on Oct. 6, 2022, which is based upon and claims priority to Chinese Patent Application No. 202111495530.4, filed on Dec. 8, 2021, the entire contents of which are incorporated herein by reference.

TECHNICAL FIELD

The present disclosure relates to an eyebrow pencil, and in particular to a rear-pressing anti-misoperation double-ended eyebrow pencil.

BACKGROUND

At present, a conventional double-ended eyebrow pencil includes one end fixed with a bristle, and the other end capable of discharging a material by rotating a nib. This is inconvenient in operation, and requires two hands for the operation. The conventional product is further defective for its lack of an anti-misoperation design. When not used, the double-ended eyebrow pencil in a bag is easily misoperated to cause outflow of the material, resulting in a waste.

SUMMARY

The present disclosure provides a rear-pressing anti-misoperation double-ended eyebrow pencil. The rear-pressing anti-misoperation double-ended eyebrow pencil is advantageous for easy operation, stable discharge and an anti-misoperation function.

To solve the technical problem, the present disclosure adopts the following technical solutions: A rear-pressing anti-misoperation double-ended eyebrow pencil includes a nib, a front lid, a piston, an intermediate ring, a pencil body, a threaded rod, a nut, a first spring, a ratchet wheel, a ratchet seat, a ratchet rod, a shoulder sleeve, a bristle carrier, a bristle, an inner sleeve, a tail lid, and a button, where the intermediate ring is shaped as a hollow rod and sleeved on the hollow pencil body; the nib is a hollow structure and is provided at one end of the pencil body; a material is provided in the nib and adjacent to an outlet; the front lid is detachably provided at an end of the pencil body adjacent to the nib; the front lid can overlay the nib; the nut is provided in the pencil body; a screw thread is provided on an inner side of the nut; the threaded rod is provided with a screw thread and rotatably provided on the nut; one end of the piston abuts against the material, and the other end of the piston abuts against the threaded rod; the piston can move to the outlet under pushing of the threaded rod; the material can move out of the outlet under pushing of the piston; the ratchet wheel and the first spring are sleeved on the threaded rod; two ends of the first spring respectively abut against the nut and the ratchet wheel; the ratchet wheel is slidably provided on the threaded rod and circumferentially fixed with the threaded rod; the ratchet rod is shaped as a hollow rod; one end of the threaded rod is inserted into the ratchet rod; the threaded rod can axially move and rotate in the ratchet rod; the ratchet seat is shaped as a hollow ring and provided in the pencil body; one end of the ratchet rod is inserted into the ratchet seat; an end of the ratchet wheel adjacent to the ratchet rod is provided with a first unidirectional jump tooth; an end of the ratchet rod adjacent to the ratchet wheel is provided with a ratchet; a second unidirectional jump tooth is provided inside an end of the ratchet seat adjacent to the ratchet wheel; the ratchet wheel can rotate under pushing of the ratchet rod; the first unidirectional jump tooth can be clamped into the second unidirectional jump tooth; the shoulder sleeve is provided at an end of the pencil body away from the nib; an end of the ratchet rod away from the ratchet penetrates through the shoulder sleeve; the bristle carrier is sleeved on the end of the ratchet rod away from the ratchet; the bristle carrier and the ratchet rod are circumferentially fixed; the bristle is provided on the bristle carrier; the tail lid is detachably provided at an end of the pencil body adjacent to the bristle carrier; the tail lid can overlay the bristle; the button is provided at an end of the tail lid; the inner sleeve is slidably provided in the tail lid; one end of the inner sleeve abuts against the bristle carrier, and the other end of the inner sleeve is connected to the button; the ratchet rod, the ratchet wheel, the bristle carrier and the inner sleeve can axially move toward the material under pushing of the button and are restored through an elastic force of the first spring; the bristle carrier and the shoulder sleeve are provided with a locking device; and in response to a locked state of the locking device, the bristle carrier and the shoulder sleeve are axially fixed.

Preferably, the locking device includes a rotating rib and a stepped limit portion cooperating with the rotating rib; the rotating rib is provided inside the shoulder sleeve; the stepped limit portion is provided at an end of the bristle carrier away from the bristle; the shoulder sleeve is rotatably connected to the pencil body; the shoulder sleeve and the tail lid are circumferentially fixed; and the rotating rib can move in or out of the stepped limit portion under driving of the tail lid.

Preferably, the shoulder sleeve and the tail lid are circumferentially fixed through a stopping rib.

Preferably, a second spring is provided between the tail lid and the inner sleeve, and the second spring can pull the button on the inner sleeve into the tail lid.

Preferably, the bristle carrier and the ratchet rod are circumferentially fixed through a stopping rib.

Preferably, the tail lid is connected to the shoulder sleeve through a clamping point.

Preferably, the inner sleeve is connected to the button through a fastener.

Preferably, the intermediate ring is made of aluminum.

Preferably, a weight is further provided in the pencil body, and the weight is provided between the nib and the nut.

The present disclosure has the following beneficial technical effects: According to the rear-pressing anti-misoperation double-ended eyebrow pencil, the nib is a hollow structure and is provided at a lower end of the pencil body. A material is provided in the nib and adjacent to an outlet. The front lid is configured to protect the nib. The nut is provided in the pencil body. A screw thread is provided on an inner side of the nut. The threaded rod is provided with a screw thread and rotatably provided on the nut. The nut can axially move through rotation of the threaded rod. The piston includes a lower end abutting against the material and an upper end abutting against the threaded rod. The piston is configured to push out the material. The ratchet wheel and the first spring are sleeved on the threaded rod. Two ends of the first spring respectively abut against the nut and the ratchet wheel. The ratchet wheel is slidably provided on the threaded rod and circumferentially fixed with the threaded rod. The ratchet rod is shaped as a hollow rod. An upper end of the threaded rod is inserted into the ratchet rod. The threaded rod can axially move and rotate in the ratchet rod. The ratchet seat is shaped as a hollow ring and provided in the pencil body. A lower end of the ratchet rod is inserted into the ratchet seat. An upper end of the ratchet wheel is provided with a first unidirectional jump tooth. The lower end of the ratchet rod is provided with a ratchet. A second unidirectional jump tooth is provided inside a lower end of the ratchet seat. The ratchet wheel can rotate under pushing of the ratchet rod. Through cooperation between the ratchet and the first unidirectional jump tooth, the ratchet wheel can be driven, thereby driving the threaded rod to rotate and pushing the material to discharge. The first unidirectional jump tooth can be clamped into the second unidirectional jump tooth. The second unidirectional jump tooth can ensure that the ratchet wheel has a same angle in each rotation and a same amount in each discharge. The shoulder sleeve is provided at an upper end of the pencil body away from the nib. An upper end of the ratchet rod penetrates through the shoulder sleeve. The bristle carrier is sleeved on the upper end of the ratchet rod. The bristle is provided on the bristle carrier. The tail lid is detachably provided at an upper end of the pencil body. While protecting the bristle, the tail lid is provided with the button. The button is provided at an end of the tail lid. The inner sleeve is slidably provided in the tail lid. The inner sleeve includes a lower end abutting against the bristle carrier and an upper end connected to the button. The ratchet rod, the ratchet wheel, the bristle carrier and the inner sleeve transfer a pressure of the button layer by layer, such that the ratchet wheel rotates, thereby driving the threaded rod to rotate and pushing out the material. Then, the ratchet rod, the ratchet wheel, the bristle carrier and the inner sleeve are restored through an elastic force of the first spring, thereby realizing a rear-pressing discharge function. The bristle carrier and the shoulder sleeve are provided with a locking device. In response to a locked state of the locking device, the bristle carrier and the shoulder sleeve are axially fixed. The locking device can prevent misoperation. When the bristle carrier and the shoulder sleeve are axially fixed, the bristle carrier neither moves axially, nor pushes the ratchet rod. Therefore, the ratchet rod does not push the ratchet wheel to rotate to discharge the material, thus preventing a waste. The present disclosure is advantageous for easy operation, stable discharge and an anti-misoperation function.

IN THE FIGURES

1: nib, 2: front lid, and 3: piston;
4: intermediate ring, 5: pencil body, and 6: threaded rod;
7: nut, 8: first spring, and 9: ratchet wheel;
91: first unidirectional jump tooth, 10: ratchet seat, and 101: second unidirectional jump tooth;
11: ratchet rod, 111: ratchet, and 12: shoulder sleeve;
121: rotating rib, 13: bristle carrier, and 131: stepped limit portion;
14: bristle, 15: inner sleeve, and 16: tail lid;
17: button, 18: material, and 19: second spring; and
20: weight.

DETAILED DESCRIPTION OF THE EMBODIMENTS

In order to understand the technical means of the present disclosure more clearly and implement the technical means according to contents in the specification, specific implementations of the present disclosure will be further described below in detail with reference to the accompanying drawings and embodiments. The embodiments described below are intended to illustrate the present disclosure, rather than limit the scope of the present disclosure.

Figure 1:
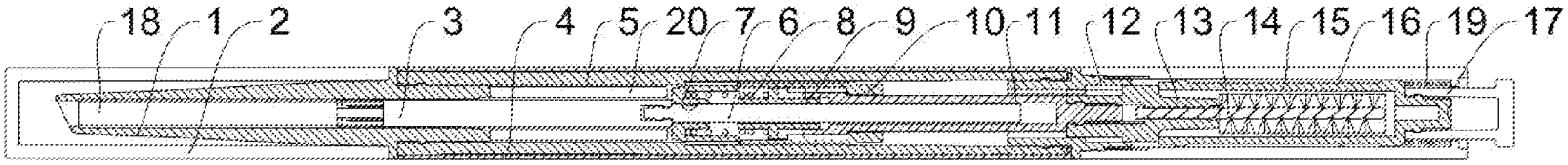
FIG. 1 is an overall sectional view according to the present disclosure.
Figure 2:
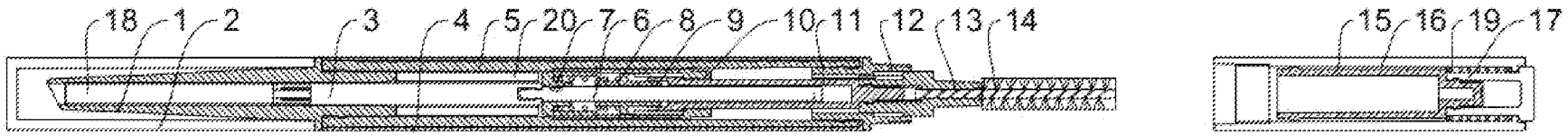
FIG. 2 is an overall sectional view when a tail lid is taken down according to the present disclosure.
Figure 3:
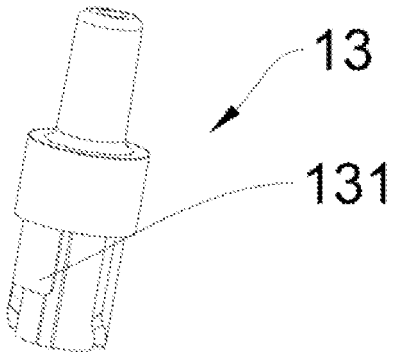
FIG. 3 is a perspective view of a bristle carrier according to the present disclosure.
Figure 4:
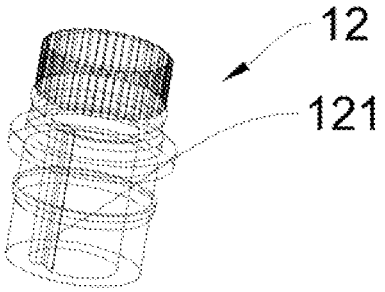
FIG. 4 is a perspective view of a shoulder sleeve according to the present disclosure.
Figure 5:
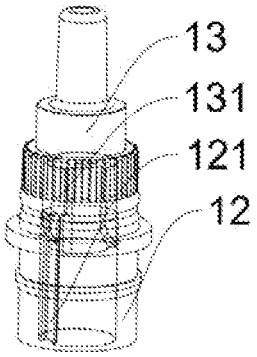
FIG. 5 is a perspective view when a rotating rib moves to a stepped limit portion according to the present disclosure.
Figure 6:
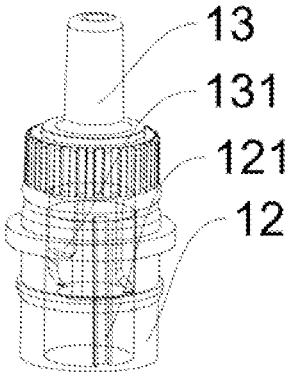
FIG. 6 is a perspective view when a rotating rib moves out of a stepped limit portion according to the present disclosure.
Figure 7:
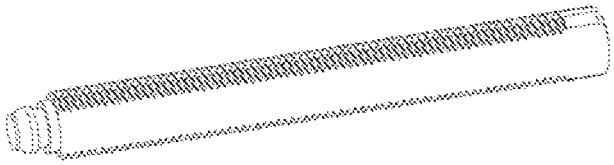
FIG. 7 is a perspective view of a threaded rod according to the present disclosure.
Figure 8:
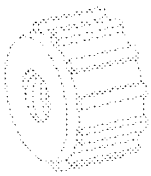
FIG. 8 is a perspective view of a nut according to the present disclosure.
Figure 9:
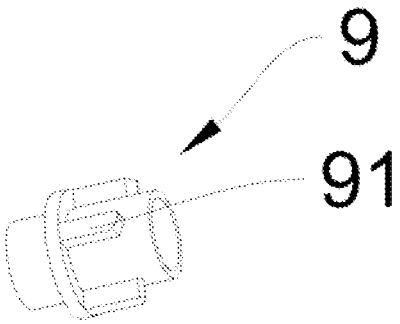
FIG. 9 is a perspective view of a ratchet wheel according to the present disclosure.
Figure 10:
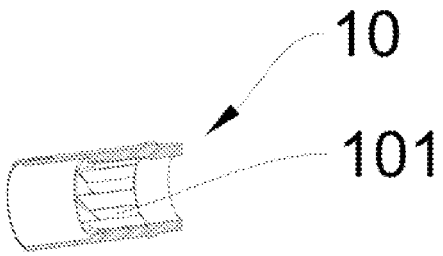
FIG. 10 is a perspective view of a ratchet seat according to the present disclosure.
Figure 11:
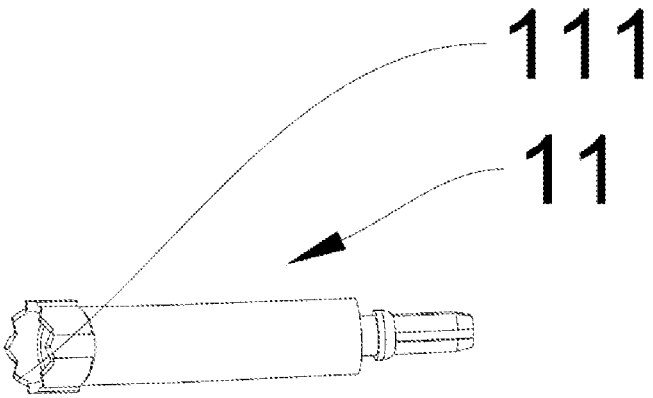
FIG. 11 is a perspective view of a ratchet rod according to the present disclosure.
Figure 12:
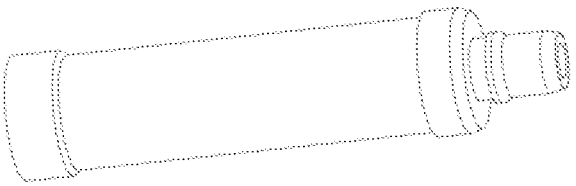
FIG. 12 is a perspective view of an inner sleeve according to the present disclosure.

A rear-pressing anti-misoperation double-ended eyebrow pencil provided by the present disclosure is described in detail in a specific embodiment. As shown in FIG. 1 to FIG. 12, the rear-pressing anti-misoperation double-ended eyebrow pencil includes nib 1, front lid 2, piston 3, intermediate ring 4, pencil body 5, threaded rod 6, nut 7, first spring 8, ratchet wheel 9, ratchet seat 10, ratchet rod 11, shoulder sleeve 12, bristle carrier 13, bristle 14, inner sleeve 15, tail lid 16, and button 17. The intermediate ring 4 is shaped as a hollow rod and sleeved on the hollow pencil body 5. The nib 1 is a hollow structure and is provided at one end of the pencil body 5. Material 18 is provided in the nib 1 and adjacent to an outlet. The front lid 2 is detachably provided at an end of the pencil body 5 adjacent to the nib 1. The front lid 2 can overlay the nib 1. The front lid 2 can protect the nib 1. The nut 7 is provided in the pencil body 5. A screw thread is provided on an inner side of the nut 7. The threaded rod 6 is provided with a screw thread and rotatably provided on the nut 7. The nut can axially move through rotation of the threaded rod 6. One end of the piston 3 abuts against the material 18, and the other end of the piston 3 abuts against the threaded rod 6. The piston 3 can move to the outlet under pushing of the threaded rod 6. The material 18 can move out of the outlet under pushing of the piston 3. The piston 3 is configured to push out the material 18. The ratchet wheel 9 and the first spring 8 are sleeved on the threaded rod 6. Two ends of the first spring 8 respectively abut against the nut 7 and the ratchet wheel 9. The ratchet wheel 9 is slidably provided on the threaded rod 6 and circumferentially fixed with the threaded rod 6. The ratchet rod 11 is shaped as a hollow rod. One end of the threaded rod 6 is inserted into the ratchet rod 11. The threaded rod 6 can axially move and rotate in the ratchet rod 11. The ratchet seat 10 is shaped as a hollow ring and provided in the pencil body 5. One end of the ratchet rod 11 is inserted into the ratchet seat 10. An end of the ratchet wheel 9 adjacent to the ratchet rod 11 is provided with first unidirectional jump tooth 91. An end of the ratchet rod 11 adjacent to the ratchet wheel 9 is provided with ratchet 111. Second unidirectional jump tooth 101 is provided inside an end of the ratchet seat 10 adjacent to the ratchet wheel 9. The ratchet wheel 9 can rotate under pushing of the ratchet rod 11. Through cooperation between the ratchet 111 and the first unidirectional jump tooth 91, the ratchet wheel 9 can be driven, thereby driving the threaded rod 6 to rotate and pushing the material 18 to discharge. The first unidirectional jump tooth 91 can be clamped into the second unidirectional jump tooth 101. The second unidirectional jump tooth 101 can ensure that the ratchet wheel 9 has a same angle in each rotation and a same amount in each discharge. The shoulder sleeve 12 is provided at an end of the pencil body 5 away from the nib 1. An end of the ratchet rod 11 away from the ratchet 111 penetrates through the shoulder sleeve 12. The bristle carrier 13 is sleeved on the end of the ratchet rod 11 away from the ratchet 111. The bristle carrier 13 and the ratchet rod 11 are circumferentially fixed. The bristle 14 is provided on the bristle carrier 13. The tail lid 16 is detachably provided at an end of the pencil body 5 adjacent to the bristle carrier 13. The tail lid 16 can overlay the bristle 14. While protecting the bristle 14, the tail lid 16 is provided with the button 17. The button 17 is provided at an end of the tail lid 16. The inner sleeve 15 is slidably provided in the tail lid 16. One end of the inner sleeve 15 abuts against the bristle carrier 13, and the other end of the inner sleeve 15 is connected to the button 17. The ratchet rod 11, the ratchet wheel 9, the bristle carrier 13 and the inner sleeve 15 can axially move toward the material 18 under pushing of the button 17 and are restored through an elastic force of the first spring 8. The ratchet rod 11, the ratchet wheel 9, the bristle carrier 13 and the inner sleeve 15 transfer a pressure of the button 17 layer by layer, such that the ratchet wheel 9 rotates, thereby driving the threaded rod 6 to rotate and pushing out the material 18. Then, the ratchet rod, the ratchet wheel, the bristle carrier and the inner sleeve are restored through the elastic force of the first spring 8, thereby realizing a rear-pressing discharge function. The bristle carrier 13 and the shoulder sleeve 12 are provided with a locking device. In response to a locked state of the locking device, the bristle carrier 13 and the shoulder sleeve 12 are axially fixed. The locking device can prevent misoperation. When the bristle carrier 13 and the shoulder sleeve 12 are axially fixed, the bristle carrier 13 neither moves axially, nor pushes the ratchet rod 11. Therefore, the ratchet rod 11 does not push the ratchet wheel 9 to rotate to discharge the material 18, thus preventing a waste. The present disclosure is advantageous for easy operation, stable discharge and an anti-misoperation function.

In the embodiment, preferably, the locking device includes rotating rib 121 and stepped limit portion 131 cooperating with the rotating rib 121. The rotating rib 121 is provided inside the shoulder sleeve 12. The stepped limit portion 131 is provided at an end of the bristle carrier 13 away from the bristle. The shoulder sleeve 12 is rotatably connected to the pencil body 5. The shoulder sleeve 12 and the tail lid 16 are circumferentially fixed. The rotating rib 121 can move in or out of the stepped limit portion 131 under driving of the tail lid 16. By rotating the tail lid 16 circumferentially fixed with the shoulder sleeve 12, the rotating rib 121 can be clamped into the stepped limit portion 131, thereby preventing the bristle carrier 13 from axially moving. By reversely rotating the tail lid 16 circumferentially fixed with the shoulder sleeve 12, the rotating rib 121 can move out of the stepped limit portion 131, such that the bristle carrier 13 moves axially and smoothly to prevent misoperation.

In the embodiment, preferably, the shoulder sleeve 12 and the tail lid 16 are circumferentially fixed through a stopping rib. Through the stopping rib, the shoulder sleeve 12 and the tail lid 16 are circumferentially fixed more firmly.

In the embodiment, preferably, second spring 19 is provided between the tail lid 16 and the inner sleeve 15. The second spring 19 can pull the button 17 on the inner sleeve 15 into the tail lid 16. With the second spring 19, when the tail lid 16 is taken down from the pencil body 5, the button 17 can be pulled back to the tail lid 16 through a tensile force of the second spring 19, thereby protecting the button 17.

In the embodiment, preferably, the bristle carrier 13 and the ratchet rod 11 are circumferentially fixed through a stopping rib. Through the stopping rub, the bristle carrier 13 and the ratchet rod 11 are circumferentially fixed more firmly.

In the embodiment, preferably, the tail lid 16 is connected to the shoulder sleeve 12 through a clamping point. Through the clamping point, the tail lid 16 and the shoulder sleeve 12 are connected more firmly, and are assembled more conveniently.

In the embodiment, preferably, the inner sleeve 15 is connected to the button 17 through a fastener. With the fastener, the inner sleeve 15 and the button 17 are connected more firmly, and are assembled more conveniently.

In the embodiment, preferably, the intermediate ring 4 is made of aluminum. The intermediate ring 4 made of aluminum can be more wear-resistant with a higher strength.

In the embodiment, preferably, weight 20 is further provided in the pencil body 5. The weight 20 is provided between the nib 1 and the nut 7. With the weight 20 between the nib 1 and the nut 7, a barycenter of the pencil body 5 can be balanced for sake of better coordination in use.

The rear-pressing anti-misoperation double-ended eyebrow pencil in the embodiment is advantageous for easy operation, stable discharge and an anti-misoperation function.

What is claimed is:

1. A rear-pressing anti-misoperation double-ended eyebrow pencil, comprising: a nib, a front lid, a piston, an intermediate ring, a hollow pencil body, a threaded rod, a nut, a first spring, a ratchet wheel, a ratchet seat, a ratchet rod, a shoulder sleeve, a bristle carrier, a bristle, an inner sleeve, a tail lid, and a button, wherein the intermediate ring is shaped as a hollow rod and sleeved on the hollow pencil body; the nib is a hollow structure and is provided at a first end of the hollow pencil body; a material is provided in the nib and adjacent to an outlet; the front lid is detachably provided at the first end of the hollow pencil body adjacent to the nib; the front lid overlays the nib; the nut is provided in the hollow pencil body; a first screw thread is provided on an inner side of the nut; the threaded rod is provided with a second screw thread and rotatably provided on the nut; a first end of the piston abuts against the material, and a second end of the piston abuts against the threaded rod; the piston moves to the outlet under pushing of the threaded rod; the material moves out of the outlet under pushing of the piston; the ratchet wheel and the first spring are sleeved on the threaded rod; two ends of the first spring respectively abut against the nut and the ratchet wheel; the ratchet wheel is slidably provided on the threaded rod and circumferentially fixed with the threaded rod; the ratchet rod is shaped as a hollow rod; one end of the threaded rod is inserted into the ratchet rod; the threaded rod axially moves and rotates in the ratchet rod; the ratchet seat is shaped as a hollow ring and provided in the hollow pencil body; a first end of the ratchet rod is inserted into the ratchet seat; an end of the ratchet wheel adjacent to the ratchet rod is provided with a first unidirectional jump tooth; the first end of the ratchet rod adjacent to the ratchet wheel is provided with a ratchet; a second unidirectional jump tooth is provided inside an end of the ratchet seat adjacent to the ratchet wheel; the ratchet wheel rotates under pushing of the ratchet rod; the first unidirectional jump tooth is clamped into the second unidirectional jump tooth; the shoulder sleeve is provided at a second end of the hollow pencil body away from the nib; a second end of the ratchet rod away from the ratchet penetrates through the shoulder sleeve; the bristle carrier is sleeved on the second end of the ratchet rod-away from the ratchet; the bristle carrier and the ratchet rod are circumferentially fixed; the bristle is provided on the bristle carrier; the tail lid is detachably provided at the second end of the hollow pencil body adjacent to the bristle carrier; the tail lid overlays the bristle; the button is provided at an end of the tail lid; the inner sleeve is slidably provided in the tail lid; a first end of the inner sleeve abuts against the bristle carrier, and a second end of the inner sleeve is connected to the button; the ratchet rod, the ratchet wheel, the bristle carrier and the inner sleeve axially move toward the material under pushing of the button and are restored through an elastic force of the first spring; the bristle carrier and the shoulder sleeve are provided with a locking device; and in response to a locked state of the locking device, the bristle carrier and the shoulder sleeve are axially fixed.

2. The rear-pressing anti-misoperation double-ended eyebrow pencil according to claim 1, wherein the locking device comprises a rotating rib and a stepped limit portion cooperating with the rotating rib; the rotating rib is provided inside the shoulder sleeve; the stepped limit portion is provided at an end of the bristle carrier away from the bristle; the shoulder sleeve is rotatably connected to the hollow pencil body; the shoulder sleeve and the tail lid are circumferentially fixed; and the rotating rib moves in or out of the stepped limit portion under driving of the tail lid.

3. The rear-pressing anti-misoperation double-ended eyebrow pencil according to claim 2, wherein a weight is provided in the hollow pencil body, and the weight is provided between the nib and the nut.

4. The rear-pressing anti-misoperation double-ended eyebrow pencil according to claim 2, wherein the shoulder sleeve and the tail lid are circumferentially fixed through a stopping rib.

5. The rear-pressing anti-misoperation double-ended eyebrow pencil according to claim 4, wherein a weight is provided in the hollow pencil body, and the weight is provided between the nib and the nut.

6. The rear-pressing anti-misoperation double-ended eyebrow pencil according to claim 1, wherein a second spring is provided between the tail lid and the inner sleeve, and the second spring pulls the button on the inner sleeve into the tail lid.

7. The rear-pressing anti-misoperation double-ended eyebrow pencil according to claim 6, wherein a weight is provided in the hollow pencil body, and the weight is provided between the nib and the nut.

8. The rear-pressing anti-misoperation double-ended eyebrow pencil according to claim 1, wherein the bristle carrier and the ratchet rod are circumferentially fixed through a stopping rib.

9. The rear-pressing anti-misoperation double-ended eyebrow pencil according to claim 8, wherein a weight is provided in the hollow pencil body, and the weight is provided between the nib and the nut.

10. The rear-pressing anti-misoperation double-ended eyebrow pencil according to claim 1, wherein the tail lid is connected to the shoulder sleeve through a clamping point.

11. The rear-pressing anti-misoperation double-ended eyebrow pencil according to claim 10, wherein a weight is provided in the hollow pencil body, and the weight is provided between the nib and the nut.

12. The rear-pressing anti-misoperation double-ended eyebrow pencil according to claim 1, wherein the inner sleeve is connected to the button through a fastener.

13. The rear-pressing anti-misoperation double-ended eyebrow pencil according to claim 12, wherein a weight is provided in the hollow pencil body, and the weight is provided between the nib and the nut.

14. The rear-pressing anti-misoperation double-ended eyebrow pencil according to claim 1, wherein the intermediate ring is made of aluminum.

15. The rear-pressing anti-misoperation double-ended eyebrow pencil according to claim 14, wherein a weight is provided in the hollow pencil body, and the weight is provided between the nib and the nut.

16. The rear-pressing anti-misoperation double-ended eyebrow pencil according to claim 1, wherein a weight is provided in the hollow pencil body, and the weight is provided between the nib and the nut.

* * * * *